US010344493B2

(12) United States Patent
Scatterday et al.

(10) Patent No.: US 10,344,493 B2
(45) Date of Patent: Jul. 9, 2019

(54) CLEANING HEAD FOR AN IN-FLOOR POOL CLEANING SYSTEM

(71) Applicant: Blue Square Manufacturing, LLC, Chandler, AZ (US)

(72) Inventors: Mark Scatterday, Scottsdale, AZ (US); Michael Landis, Gilbert, AZ (US); Jason Addink, Gilbert, AZ (US); Mark Johnson, Tempe, AZ (US); David Johnson, New River, AZ (US); Robert Michael Long, Chandler, AZ (US); Timothy Murphy, Scottsdale, AZ (US)

(73) Assignee: Blue Square Manufacturing, LLC, Chandler, AZ (US)

( * ) Notice: Subject to any disclaimer, the term of this patent is extended or adjusted under 35 U.S.C. 154(b) by 258 days.

(21) Appl. No.: 15/356,299

(22) Filed: Nov. 18, 2016

(65) Prior Publication Data

US 2017/0159309 A1 Jun. 8, 2017

Related U.S. Application Data

(60) Provisional application No. 62/257,108, filed on Nov. 18, 2015.

(51) Int. Cl.

| | |
|---|---|
| ***B05B 3/16*** | (2006.01) |
| ***E04H 4/16*** | (2006.01) |
| ***B05B 15/70*** | (2018.01) |
| ***B05B 15/74*** | (2018.01) |

(52) U.S. Cl.

CPC ..... *E04H 4/169* (2013.01); *B05B 3/16* (2013.01); *B05B 15/70* (2018.02); *B05B 15/74* (2018.02)

(58) Field of Classification Search

CPC .. E04H 4/169; B05B 3/14; B05B 3/16; B05B 15/70; B05B 15/72; B05B 15/74

USPC ..... 4/490, 492, 496; 239/204–206

See application file for complete search history.

(56) References Cited

U.S. PATENT DOCUMENTS

| | | | | |
|---|---|---|---|---|
| 3,018,788 | A | 9/1959 | Perlis | |
| 3,408,006 | A | 10/1968 | Stanwood | |
| 3,715,078 | A | 2/1973 | Reynolds | |
| 4,116,216 | A | 9/1978 | Rosenberg | |
| 4,220,283 | A | 9/1980 | Citron | |
| 4,840,312 | A * | 6/1989 | Tyler | B05B 15/74 239/205 |
| 6,848,124 | B2 | 2/2005 | Goettl | |

(Continued)

*Primary Examiner* — Darren W Gorman

(74) *Attorney, Agent, or Firm* — Schmeiser, Olsen & Watts LLP

(57) ABSTRACT

A cleaning head for an in-floor pool cleaning system is provided. The cleaning head includes a sleeve having a passage and an insert extending through the passage of the sleeve. The insert includes a flow path and an aperture, wherein the flow path is a curved, such as a question mark shape, and exits through the aperture. The insert is moveable between a first position with the aperture retained with in the sleeve and a second position with the aperture extending beyond the sleeve. The flow path may include an overturn at the aperture. The insert includes a nozzle, a nozzle housing, an upper guide, a lower guide and a weight with the flow path extending through each component. The nozzle includes an angled inlet opening that corresponds to an angled outlet opening of the nozzle housing that engage each other when the nozzle is coupled within the nozzle housing.

18 Claims, 10 Drawing Sheets

(56) References Cited

U.S. PATENT DOCUMENTS

| | | | | |
|---|---|---|---|---|
| 7,571,496 | B2 | 8/2009 | Martin | |
| 7,677,474 | B2 * | 3/2010 | Markley | B05B 15/70 239/451 |

* cited by examiner

CLEANING HEAD FOR AN IN-FLOOR POOL CLEANING SYSTEM

CROSS REFERENCE TO RELATED APPLICATION[S]

This application claims priority to U.S. Provisional Patent Application entitled "CLEANING HEAD FOR AN IN-FLOOR POOL CLEANING SYSTEM," Ser. No. 62/257,108, filed Nov. 18, 2015, the disclosure of which is hereby incorporated entirely herein by reference.

BACKGROUND OF THE INVENTION

Technical Field

This invention relates generally to in-floor pool cleaning systems and more particularly to heads for in-floor pool cleaning systems.

State of the Art

In-floor pool cleaning systems have been developed that clean the inner surfaces of a pool by using pressurized bursts of water from cleaning heads mounted in the floor, sides and/or steps of the pool to move debris (which includes dirt, leaves and other material in the pool) into one or more drains where vacuum pulls the debris into a filtering system. A pump, a distribution valve connected to the pump, and one or more cleaning heads connected to the distribution valve are used in a typical in-floor cleaning system. The pump delivers pressurized water into the distribution valve, which directs the pressurized water to successively control the operation of one or more cleaning heads at a time.

Cleaning heads are mounted in the floor, side or steps of a pool and are preferably flush with the pool surface. When pressurized water is diverted by the valve to a particular cleaning head (or group of cleaning heads), the pressurized water enters the insert and pushes the insert partially out of the sleeve so that the opening in the insert extends beyond the sleeve. The insert has an aperture through which pressurized water flows in order to push debris towards a drain. Conventional cleaning heads are limited in their effectiveness to move debris because of the flow of pressurized water through the cleaning head. Accordingly, there is a need for an improved cleaning head for in-floor pool cleaning systems.

DISCLOSURE OF THE INVENTION

The present invention relates to a cleaning head for use within an in-floor pool cleaning system. The cleaning head improves the cleaning ability of the cleaning head over existing cleaning heads.

An embodiment includes a cleaning head for an in-floor pool cleaning system, the cleaning head comprising: a sleeve having a passage; and an insert extending through the passage of the sleeve, the insert comprises a flow path and an aperture, wherein the flow path is curved flow path, and wherein the insert is moveable between a first position with the aperture retained within the sleeve and a second position with the aperture extending beyond the sleeve. The flow path may include an overturn at the aperture.

The insert may comprise a nozzle, a nozzle housing, an upper guide, a lower guide and a weight. The flow path extends through each of the nozzle, the nozzle housing, the upper guide, the lower guide and the weight. The nozzle comprises an inlet opening and an aperture, wherein the inlet opening is angled with respect to a top surface of the nozzle. The nozzle housing comprises an inlet opening and an outlet opening, wherein the outlet opening is angled with respect to a top surface of the nozzle housing. The angled inlet opening of the nozzle corresponds to the angled outlet opening of the nozzle housing and the engage each other when the nozzle is coupled within the nozzle housing.

Another embodiment includes a cleaning head for an in-floor pool cleaning system, the cleaning head comprising a sleeve having a passage; and an insert extending through the passage of the sleeve. The insert comprises a nozzle; a nozzle housing comprising an extension portion; an upper guide; a lower guide; a flow path; and an aperture, wherein the flow path is a curved flow path that exits the insert through the aperture, and wherein the insert is moveable between a first position with the aperture retained within the sleeve and a second position with the aperture extending beyond the sleeve; and wherein the extension portion of the nozzle housing extends into the upper guide when the nozzle housing is coupled to the upper guide, the extension portion forming a portion of the curved flow path.

The foregoing and other features and advantages of the present invention will be apparent from the following more detailed description of the particular embodiments of the invention, as illustrated in the accompanying drawings.

BRIEF DESCRIPTION OF THE DRAWINGS

A more complete understanding of the present invention may be derived by referring to the detailed description and claims when considered in connection with the Figures, wherein like reference numbers refer to similar items throughout the Figures, and:

DETAILED DESCRIPTION OF EMBODIMENTS OF THE INVENTION

Figure 1:
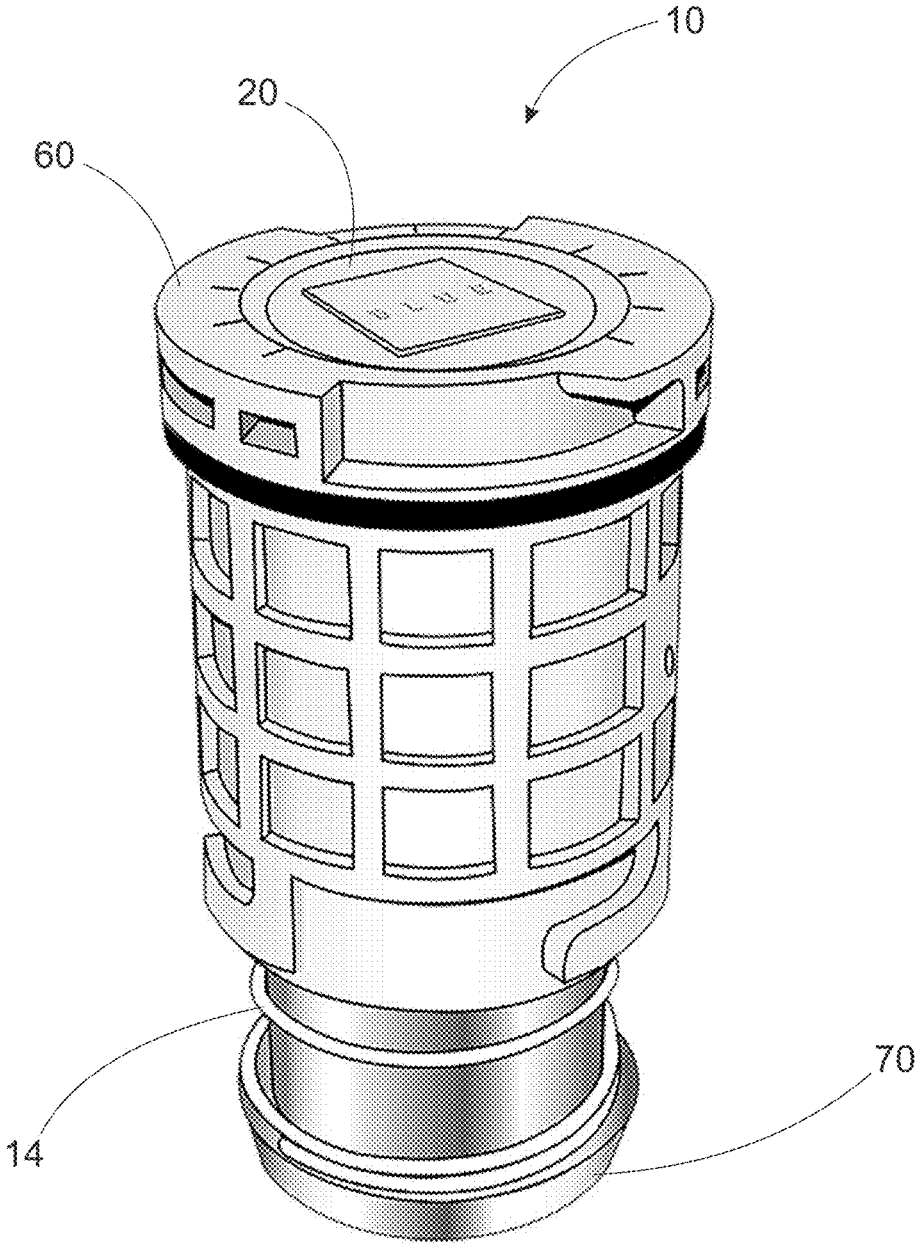
FIG. 1 is a perspective view of a cleaning head for an in-floor pool cleaning system, in accordance with embodiments.
Figure 2:
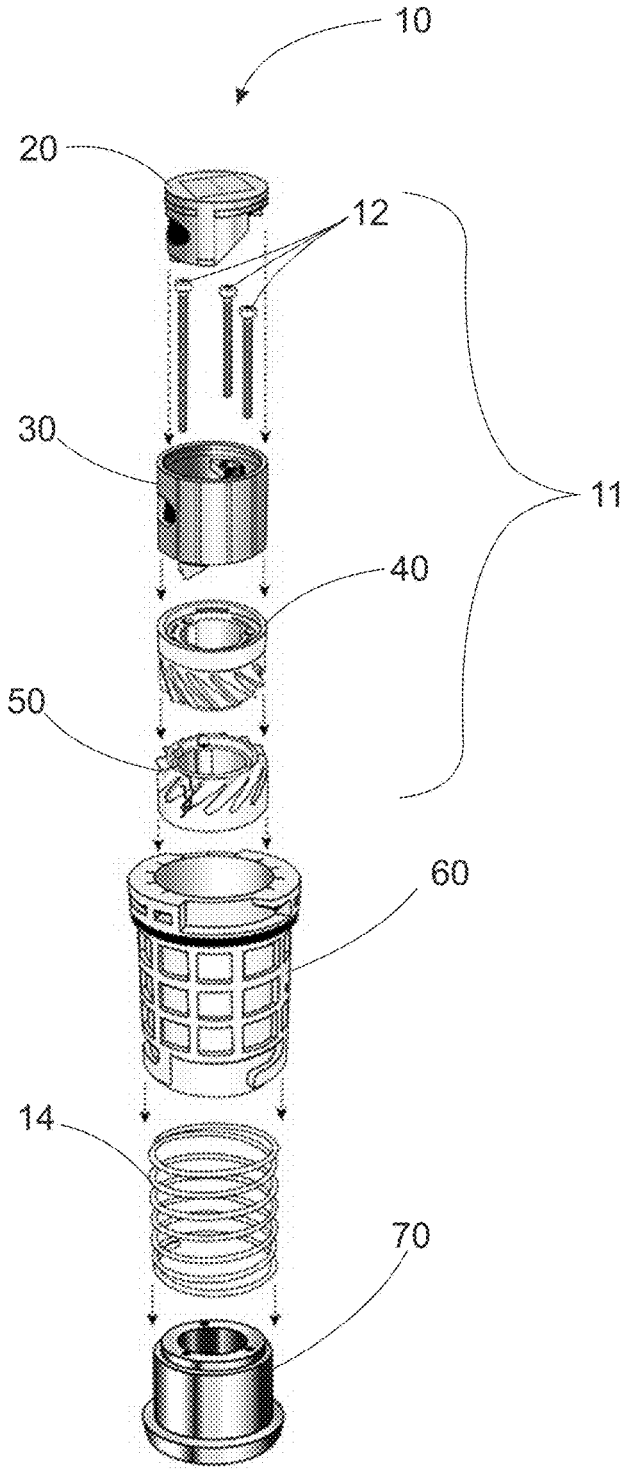
FIG. 2 is a perspective exploded view of a cleaning head for an in-floor pool cleaning system, in accordance with embodiments.
Figure 3A:
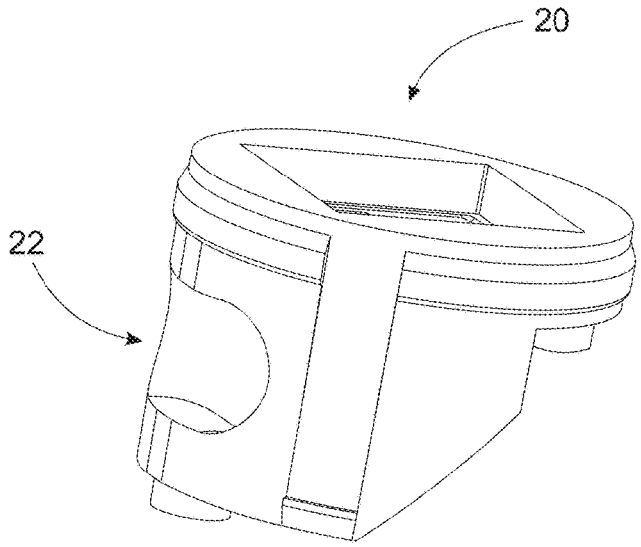
FIG. 3*a* is a top perspective view of a nozzle of a cleaning head, in accordance with embodiments.
Figure 3B:
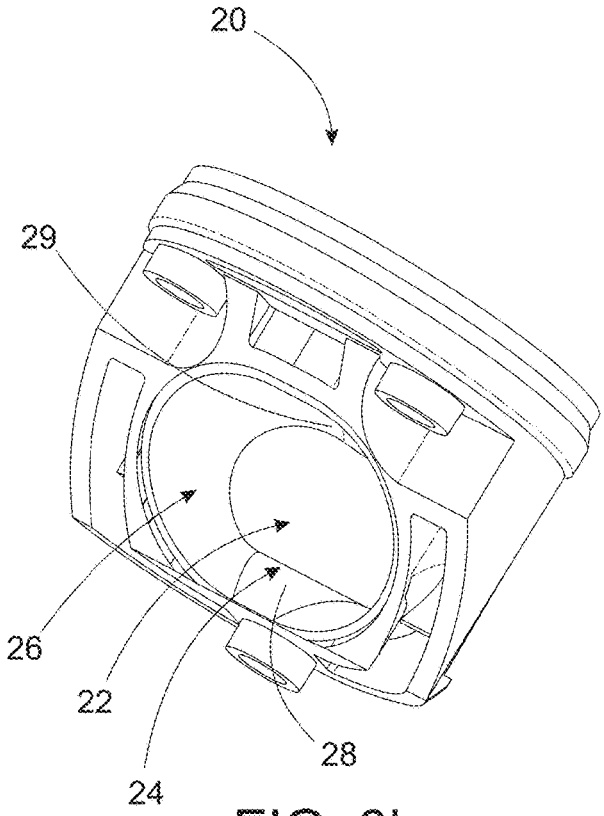
FIG. 3*b* is a bottom perspective view of a nozzle of a cleaning head, in accordance with embodiments.
Figure 4A:
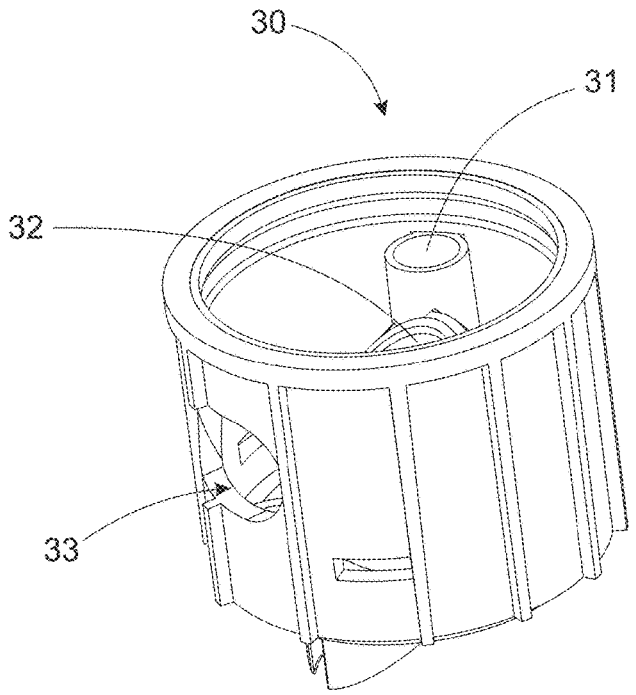
FIG. 4*a* is a top perspective view of a nozzle housing of a cleaning head, in accordance with embodiments.
Figure 4B:
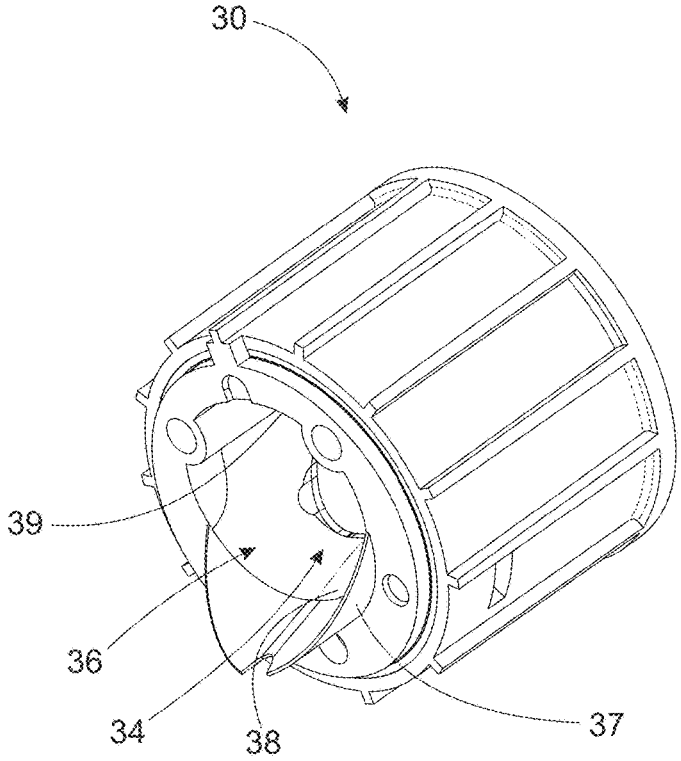
FIG. 4*b* is a bottom perspective view of a nozzle housing of a cleaning head, in accordance with embodiments.
Figure 5:
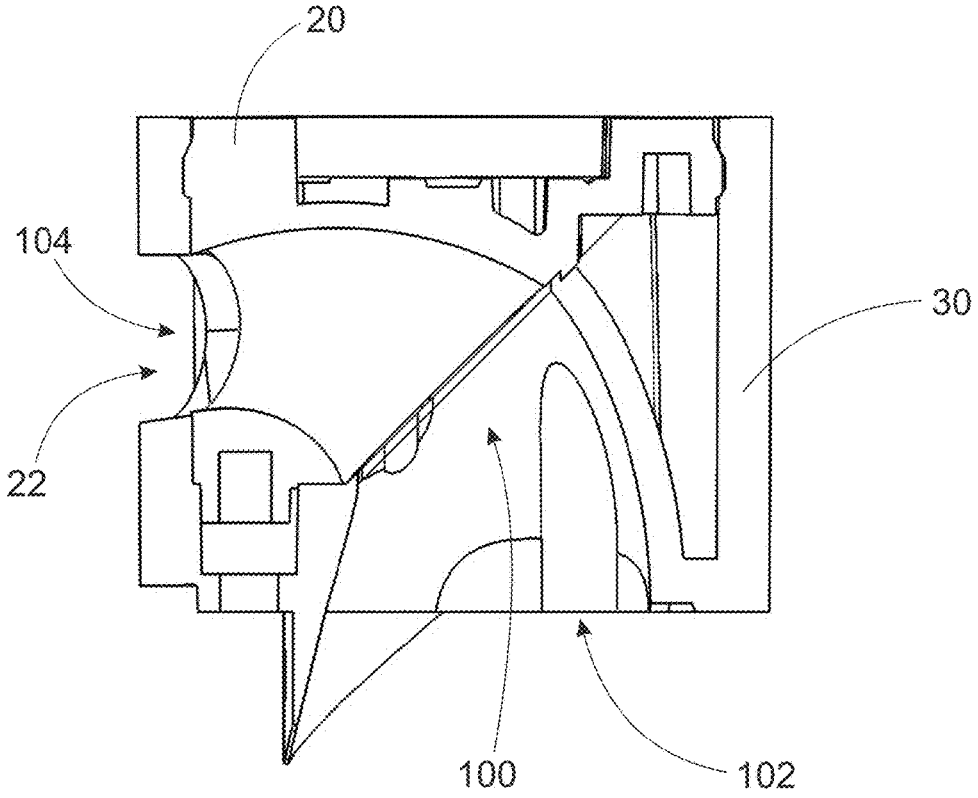
FIG. 5 is a section view of a nozzle coupled to a nozzle housing of a cleaning head, in accordance with embodiments.

As discussed above, embodiments of the present invention relate to a cleaning head for use within an in-floor pool cleaning system. The cleaning head improves the cleaning ability of the cleaning head over existing cleaning heads.

Turning now to the drawings, where the purpose is to describe an embodiment of the invention and not limit same, FIGS. 1-9 show a cleaning head (or "head") 10 according to a preferred embodiment of the invention. Cleaning head 10 generally comprises three components: a sleeve 60, an insert 11 and a biasing element 14. The function of the sleeve 60 is to mount into the interior 82 of a collar 80, shown in FIG. 9, which is already mounted in the floor, side or steps of a pool and to retain the insert 11. Any suitable structure for this function may be used.

Sleeve 60 includes a top (or first end) 62, bottom (or second end) 64 and a generally cylindrical body 66 with an outer wall 68. A passage 61 is defined within the body 66. Passage 61 allows for insert 11 to move within passage 61, such as, but not limited to sliding within passage 61 of sleeve 60. As shown, the outer wall 68 includes mounting structures 69 that are known as "bayonet-style" mounting structures. These secure the sleeve 60 into a cavity under (or behind) the surface of a pool, preferably within the interior 82 of collar 80, and any suitable mounting structure may be used.

The purpose of collar 80 is to be positioned beneath the surface of the pool and to receive sleeve 60 with insert 11 mounted therein. Sleeve 60 can be removably mounted in collar 80 by a tool. Collar 80 and sleeve 60 can have any suitable structure for releasably connecting to one another and many such structures are known in the art.

Insert 11 includes a nozzle 20, a nozzle housing 30, an upper guide 40 and a lower guide 50. The insert may be coupled to a weight 70 by use of connectors 12, through upper guide mounting holes 41, lower mounting holes 51, and connector receiving recesses 71 of weight 70. The function of insert 11 is to direct pressurized water to move debris to an area where it can be filtered from the water. As shown, each component may be cylindrical.

Nozzle 20 includes an aperture 22 and a flow path 24. Further, nozzle 20 includes inlet opening 26, wherein the inlet opening 26 is at an angle with respect to a top surface of the nozzle 20. In embodiments, and without limitation, the inlet opening 26 may be at a 45 degree angle with respect to the top surface of the nozzle 20. The flow path 24 may include an inner surface 28 and an outer surface 29. The inner surface 28 and outer surface 29 each have a curved shape.

Nozzle housing 30 includes an inlet opening 36 and a flow path 34. Further, nozzle housing 30 includes outlet opening 32, wherein the outlet opening 32 is at an angle with respect to a top surface of the nozzle housing 30. In embodiments, and without limitation, the outlet opening 32 may be at a 45 degree angle with respect to the top surface of the nozzle 30. The flow path 34 may include an inner surface 38 and an outer surface 39. The inner surface 38 and outer surface 39 each have a curved shape. The nozzle housing 30 includes an extension portion 37 that extends into the upper guide 40 when the nozzle housing 30 is coupled to the upper guide 40. The extension 37 begins the curved shape of the inner surface 38. Nozzle housing 30 further includes a side aperture 33 through which water may be emitted from the nozzle 30.

The nozzle 20 may be coupled to the nozzle housing 30, wherein the inlet opening 26 of the nozzle engages the outlet opening 32 of the nozzle housing 30. The angle of the inlet opening 26 of the nozzle 20 corresponds to the angle of the outlet opening 32 of the nozzle housing 30. The perimeter of the inlet opening 26 of the nozzle 20 may be the same size and shape as the perimeter of the outlet opening 32 of the nozzle housing 30. In this way, when the nozzle 20 is coupled to the nozzle housing 30, a continuous flow path is created between flow path 34 and flow path 24. The angle of the inlet opening 26 of the nozzle 20 and the outlet opening 32 of the nozzle housing 30 ensure that the flow path 34 is properly aligned with the flow path 24. Proper alignment of the flow paths 34 and 24 include the inner surface 38 of flow path 34 connected to the inner surface 28 of flow path 24 and the outer surface 39 of flow path 34 connected to the outer surface 29 of flow path 24. The flow paths 34/24 provide a combined flow path 100 with an inlet 102 and an outlet 104. The outlet 104. The flow path 100 may be curved in order to reduce turbulence through the flow path 100 to create more laminar flow of water. For example and without limitation, flow path 100 may include two curves, such as a question mark shape, a hook shape, and the like. The combined flow path 100 exits through aperture 22 that is aligned with opening 31 of the nozzle housing 30 to allow water flowing through the flow path 100 to exit the aperture 22 without being impeded by the nozzle housing 30.

The upper guide 40 may include a flow path 42 extending through the upper guide 40, wherein coupling the nozzle housing 30 to the upper guide 40 extends the flow path 100 through the upper guide 40. The upper guide 40 may include grooves 44 wherein each groove 44 includes a first surface 46 and a second surface 48 on either side of the groove 44. The first and second surfaces 46 and 48 are helical in shape and twist as they extend around an outer surface of the upper guide 40.

The lower guide 50 may include a flow path 52 extending through the lower guide 50, wherein coupling the upper guide 40 to the lower guide 50 extends the flow path 100 through the lower guide 50. The lower guide 50 may include grooves 54 wherein each groove 54 includes a first surface 56 and a second surface 58 on either side of the groove 54. The first and second surfaces 56 and 58 are helical in shape and twist as they extend around an outer surface of the lower guide 50.

Figure 6A:
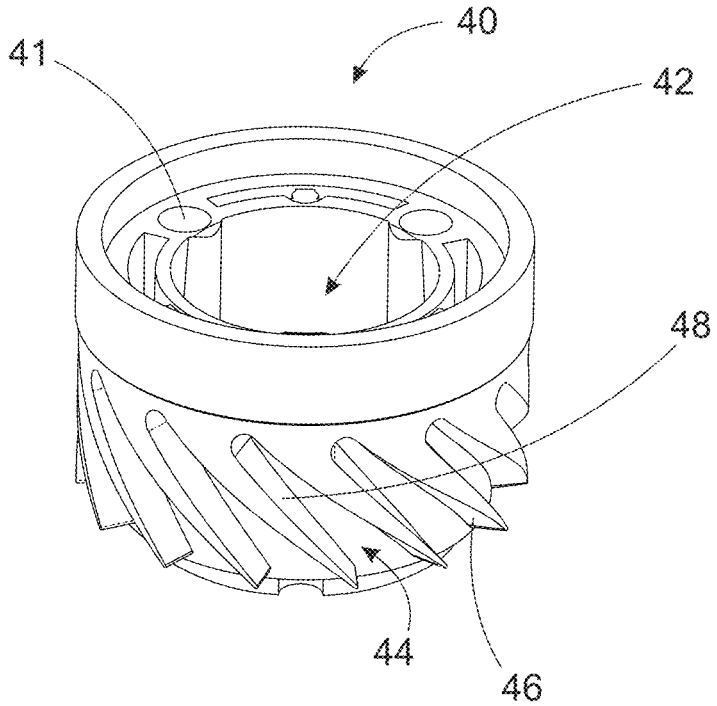
FIG. 6*a* is a perspective view of an upper guide of a cleaning head, in accordance with embodiments.
Figure 6B:
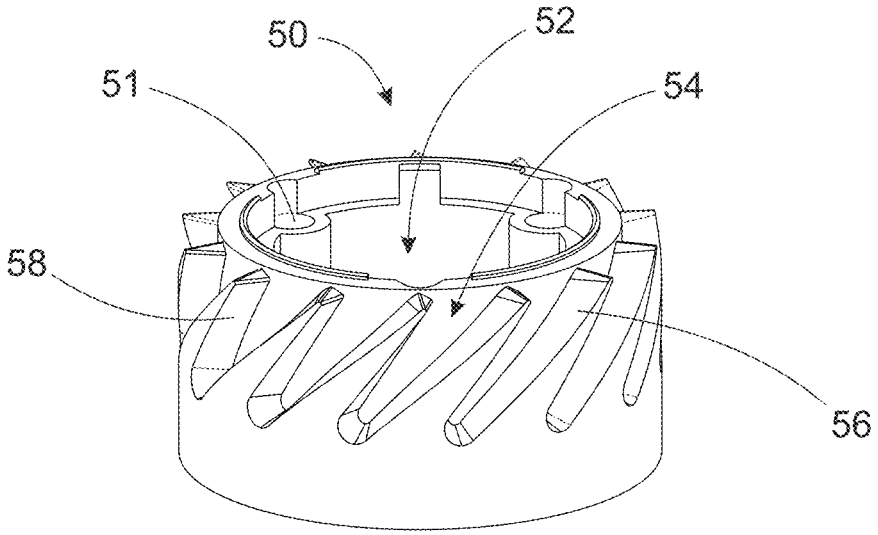
FIG. 6*b* is a perspective view of a lower guide of a cleaning head, in accordance with embodiments.
Figure 6C:
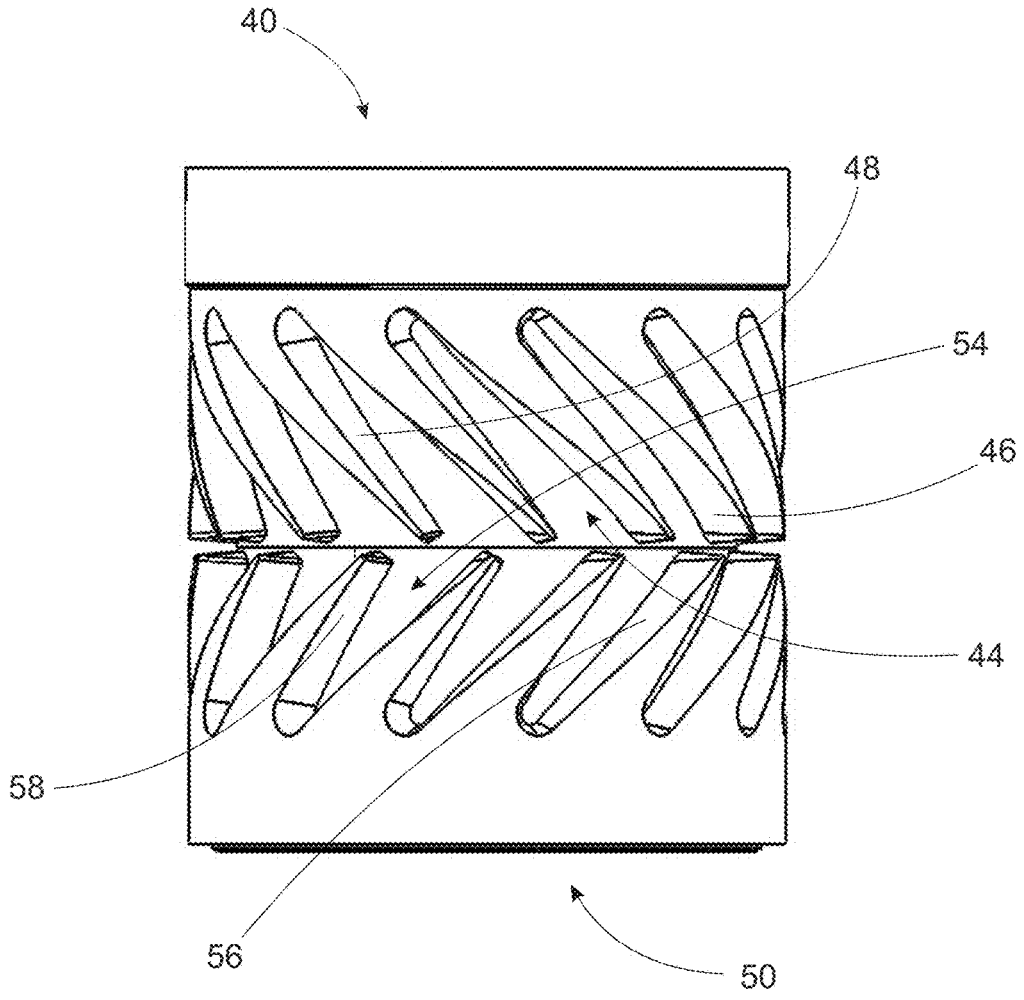
FIG. 6*c* is a side view of an upper guide coupled to a lower guide of a cleaning head, in accordance with embodiments.
Figure 7:
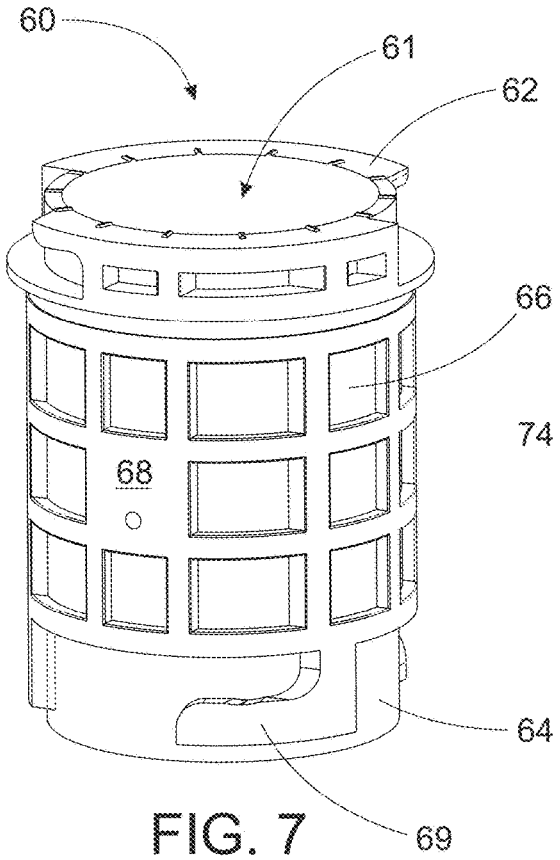
FIG. 7 is perspective view of a sleeve of a cleaning head, in accordance with embodiments.
Figure 8:
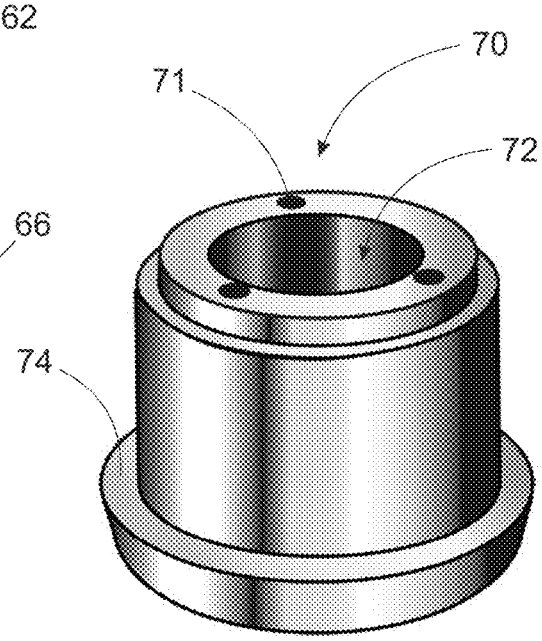
FIG. 8 is a perspective view of a weight of a cleaning head, in accordance with embodiments.
Figure 9:
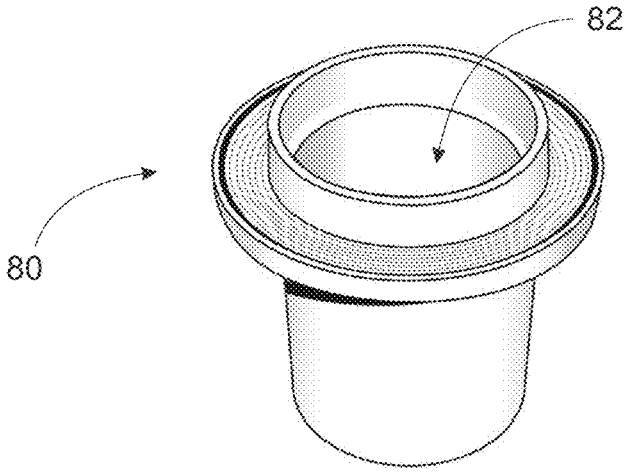
FIG. 9 is a perspective view of a collar for use with a cleaning head; in accordance with embodiments.

The purpose of grooves 44 and 54, as shown in FIG. 6*c* is to help index the insert 11. When the insert 11 is coupled within the sleeve 60, as shown in FIG. 1, one or more pins (not shown) may be coupled to the sleeve 60 within the passage 61. Each pin engages the grooves 44 and 54 on the outer surface of the upper and lower guides 40 and 50 respectively as the insert 11 moves from one or more of its first position retracted within the sleeve 60 to its second position extended from the sleeve 60, or its second position to its first position. In this manner, the insert 11, and hence aperture 22, sequentially rotates and the aperture 22, releases pressurized water to different locations on the pool surface as it rotates to different positions. The insert 11 moving from its first position to its second position and then from its second position to its first position includes one movement cycle, in one movement cycle, the pin may move from one groove 44 to another groove 54 and then back to a second groove 44 adjacent the first groove 44 at the beginning of the movement cycle. The angle of the grooves produces the indexing, while the helical twisting shape of the grooves operates to create more than one point of contact, reduces wear, reduces friction and provides a more positive advancement of the rotation of the insert 11.

The weight 70 includes a flow path 72, wherein coupling the lower guide 50 to the weight 70 extends the flow path 100 through the weight 70. Weight 70 may include a lip 74 that has a larger radius that the outer surface of the weight 70. The outer surface of the weight 70 is a size and shape to slide within the sleeve 60. The lip 74 is of a size to engage the bottom surface of the second side 64 of the sleeve 60 to prevent the insert 11 from sliding completely out of the sleeve 60 when pressurized water flows through flow path 100. Insert 11 has a first position (shown in FIG. 1) in which it is retained within sleeve 60 and the aperture 22 does not extend beyond the sleeve 60. Insert 11 has a second position in which it extends partially beyond the tope surface of the sleeve 60 and aperture 22 extends beyond the top surface of the sleeve 60.

The biasing element 14 may be a conical spring. The purpose of biasing element 14 is to bias insert 11 towards its first position and any structure or device suitable for this purpose may be used. Conical spring 14 is configured to fit over the outer surface 76 of the weight and engage each the lip 74 of the weight and a bottom surface of the sleeve 60. The biasing element 14 is partially loaded or compressed in order to a bias the insert 11 toward the first position. The weight 70 operates as another biasing element by allowing gravity to act on the weight 70. The pressurized water flowing through the flow path 100 that extends through the insert 11 is of a sufficient force to overcome the combined biasing force of the weight 70 and the force of the biasing element 14. One advantage of using a conical spring biasing element 14, as opposed to a standard, right cylindrical spring used in prior art heads is that the travel distance of the spring is less to create a suitable biasing force. Therefore, the insert 11 is smaller, thus requiring less material. A sleeve and insert according to the invention however, can be designed to retrofit existing collars.

Figure 10:
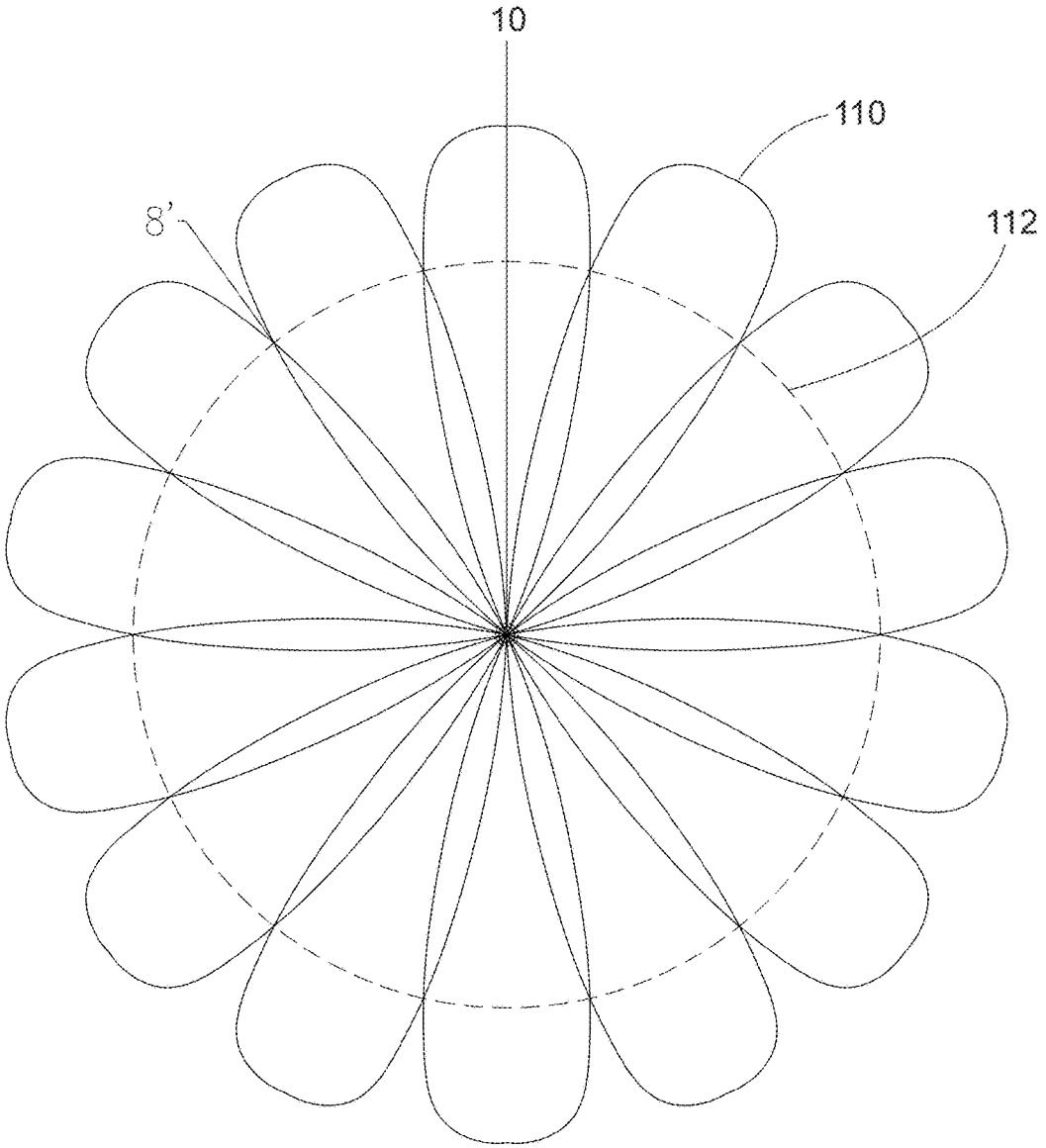
FIG. 10 is a diagrammatic view of a throw path and cleaning area of a cleaning head, in accordance with embodiments.

Referring to FIG. 10, when pressurized water is diverted from the valve to a pipe leading to a cleaning head 10 according to the invention, the pressurized water enters the bottom of the cleaning head where it flows through flow path 100 and the force of the pressurized water overcomes the biasing force of element 14 and weight 70 and moves the insert 11 from its first position to its second position in which the aperture 22 extends beyond sleeve 60. Pressurized water then escapes from aperture 22 and provides a throw 110, wherein the throw 110 is the distance that the pressurized stream of water flows along a bottom surface of a pool. As the cleaning head indexes, the throw at each indexed position overlaps to create several petals of throws 110, wherein a circle 112 is created through connecting the intersecting portions of the throw 110. The radius of the circle 112 provides the radius that the cleaning head 10 can move debris and becomes the cleaning area.

Figure 11:
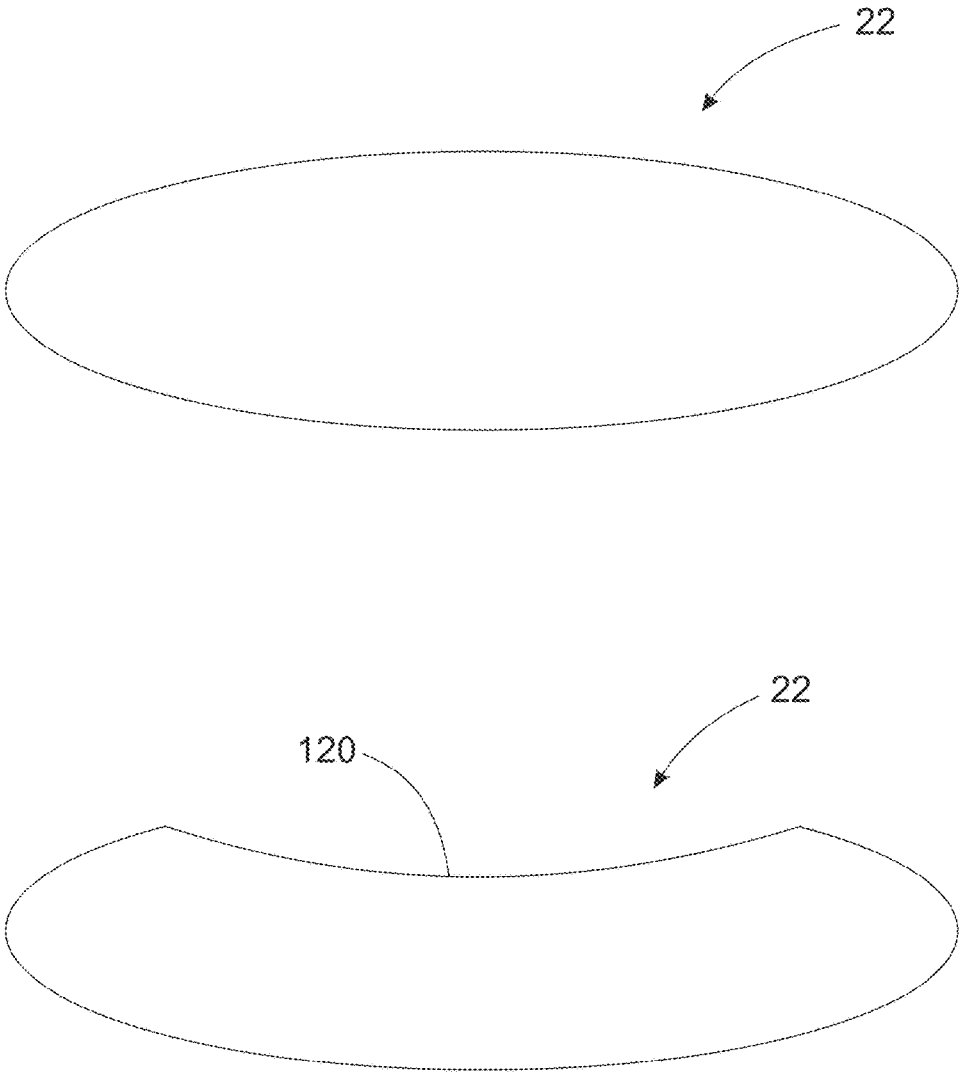
FIG. 11 is a diagram of various shapes of an aperture of a valve of a cleaning head, in accordance with embodiments.

The flow of water through the cleaning head 10 can be affected by various components. For example, and without limitation, the flow of water through the cleaning head 10 can be affected by the aperture 22. The aperture 22 may be varied in size and in shape. As shown in FIG. 11, the shape of the aperture 22 may be a race track shape or a race track shape with a turned portion 120 on the upper side of the race track shape. The size and shape of the aperture 22 may provide for different velocity of the flow leaving the aperture 22, the direction of flow leaving the aperture 22 and the concentration of volume of flow leaving the aperture 22.

Additionally, the flow path 100 is in the shape of a curved shape, like a question mark and the cross-sectional area of the flow path decreases as it progresses uniformly through the insert 11. The decreased area provides continuous acceleration of the water flowing through the flow path. The shape reduces turbulence flowing through the flow path and provides a focused cleaning path when the flow exits the aperture 22. Additionally, the flow path 100 includes an overturn at outlet 104. The overturn may be a 4 degree down turn. This overturn assists the spread of the flow by slightly bringing down the flow to spread the flow pattern and reduce the drift of the flow. Drift of the flow is how the flow dissipates the further it moves from the nozzle 20. The longer the distance before drift occurs, the better and greater the cleaning area. This occurs by forcing the flow exiting the nozzle toward the pool surface to hug the contour of the pool surface.

The components defining any cleaning head for an in-floor pool cleaning system may be formed of any of many different types of materials or combinations thereof that can readily be formed into shaped objects provided that the components selected are consistent with the intended operation of a cleaning head for an in-floor pool cleaning system. For example, the components may be formed of: rubbers (synthetic and/or natural) and/or other like materials; glasses (such as fiberglass) carbon-fiber, aramid-fiber, any combination thereof, and/or other like materials; polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; composites and/or other like materials; metals, such as zinc, magnesium, titanium, copper, iron, steel, carbon steel, alloy steel, tool steel, stainless steel, aluminum, any combination thereof, and/or other like materials; alloys, such as aluminum alloy, titanium alloy, magnesium alloy, copper alloy, any combination thereof, and/or other like materials; any other suitable material; and/or any combination thereof.

Furthermore, the components defining any cleaning head for an in-floor pool cleaning system may be purchased pre-manufactured or manufactured separately and then assembled together. However, any or all of the components may be manufactured simultaneously and integrally joined with one another. Manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components. Other possible steps might include sand blasting, polishing, powder coating, zinc plating, anodizing, hard anodizing, and/or painting the components for example.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A cleaning head for an in-floor pool cleaning system, the cleaning head comprising:

a sleeve having a passage; and an insert extending through the passage of the sleeve, the insert comprises a flow path and an aperture, wherein the flow path is a curved flow path that exits the insert through the aperture, wherein the flow path includes an overturn at the aperture, and wherein the insert is moveable between a first position with the aperture retained within the sleeve and a second position with the aperture extending beyond the sleeve.

2. The cleaning head of claim 1, wherein the insert comprises:

a nozzle;

a nozzle housing;

an upper guide further comprising a plurality of grooves, each of the plurality of grooves of the upper guide having a first and second surface on either side of the groove, wherein each of the first and second surfaces are helical in shape and twist as they extend in a first direction around an outer surface of the upper guide;

a lower guide further comprising a plurality of grooves, each of the plurality of grooves of the lower guide having a first and second surface on either side of the groove, wherein each of the first and second surfaces are helical in shape and twist as they extend in a second direction around an outer surface of the lower guide;

at least one pin coupled to the sleeve within the passage; and a weight.

3. The cleaning head of claim 2, wherein the flow path extends through the nozzle, the nozzle housing, the upper guide, the lower guide and the weight, wherein the at least one pin engages the grooves on the outer surface of the upper and lower guides as the insert moves from one or more of its first position retracted within the sleeve to its second position extended from the sleeve, or its second position to its first position, thereby sequentially rotating the aperture such that the aperture releases pressurized water flowing through the flow path to different locations on the surface of a pool as it rotates to different positions when the insert is coupled within the sleeve to a water supply as the water supply is successively pressurized and depressurized.

4. The cleaning head of claim 2, wherein the nozzle comprises an inlet opening and the aperture of the insert, wherein the inlet opening is angled with respect to a top surface of the nozzle.

5. The cleaning head of claim 4, wherein the nozzle housing comprises an inlet opening and an outlet opening, wherein the outlet opening is angled with respect to a top surface of the nozzle housing.

6. The cleaning head of claim 5, wherein the angled inlet opening of the nozzle corresponds to the angled outlet opening of the nozzle housing and the angled inlet opening of the nozzle and the angled outlet opening of the nozzle housing engage each other when the nozzle is coupled within the nozzle housing.

7. The cleaning head of claim 2, further comprising a biasing element to bias the insert toward the first position.

8. The cleaning head of claim 7, wherein the biasing element couples over an outer surface of the weight and engages a lip of the weight and engages a bottom surface of the sleeve.

9. The cleaning head of claim 1, wherein the curved flow path is a question mark shaped flow path.

10. A cleaning head for an in-floor pool cleaning system, the cleaning head comprising:

a sleeve having a passage; and an insert extending through the passage of the sleeve, the insert comprising:

a nozzle;

a nozzle housing comprising an extension portion;

an upper guide further comprising a plurality of grooves, each of the plurality of grooves of the upper guide having a first and second surface on either side of the groove, wherein each of the first and second surfaces are helical in shape and twist as they extend in a first direction around an outer surface of the upper guide;

a lower guide further comprising a plurality of grooves, each of the plurality of grooves of the lower guide having a first and second surface on either side of the groove, wherein each of the first and second surfaces are helical in shape and twist as they extend in a second direction around an outer surface of the lower guide;

a flow path; and an aperture, wherein the flow path is a curved flow path that exits the insert through the aperture, wherein the flow path includes an overturn at the aperture, and wherein the insert is moveable between a first position with the aperture retained within the sleeve and a second position with the aperture extending beyond the sleeve; and wherein the extension portion of the nozzle housing extends into the upper guide when the nozzle housing is coupled to the upper guide, the extension portion forming a portion of the curved flow path.

11. The cleaning head of claim 10, wherein the insert further comprises:

at least one pin coupled to the sleeve within the passage; and a weight.

12. The cleaning head of claim 11, wherein the flow path extends through the nozzle, the nozzle housing, the upper guide, the lower guide and the weight, wherein the at least one pin engages the grooves on the outer surface of the upper and lower guides as the insert moves from one or more of its first position retracted within the sleeve to its second position extended from the sleeve, or its second position to its first position, thereby sequentially rotating the aperture such that the aperture releases pressurized water flowing through the flow path to different locations on the surface of a pool as it rotates to different positions when the insert is coupled within the sleeve to a water supply as the water supply is successively pressurized and depressurized.

13. The cleaning head of claim 11, wherein the nozzle comprises an inlet opening and the aperture of the insert, wherein the inlet opening is angled with respect to a top surface of the nozzle.

14. The cleaning head of claim 13, wherein the nozzle housing comprises an inlet opening and an outlet opening, wherein the outlet opening is angled with respect to a top surface of the nozzle housing.

15. The cleaning head of claim 14, wherein the angled inlet opening of the nozzle corresponds to the angled outlet opening of the nozzle housing and the angled inlet opening of the nozzle and the angled outlet opening of the nozzle housing engage each other when the nozzle is coupled within the nozzle housing.

16. The cleaning head of claim 11, further comprising a biasing element to bias the insert toward the first position.

17. The cleaning head of claim 16, wherein the biasing element couples over an outer surface of the weight and engages a lip of the weight and engages a bottom surface of the sleeve.

18. The cleaning head of claim 10, wherein the curved flow path is a question mark shaped flow path.

* * * * *